US012677880B2

(12) United States Patent
Seo et al.

(10) Patent No.: US 12,677,880 B2
(45) Date of Patent: Jul. 14, 2026

(54) HEATING ASSEMBLY AND AEROSOL GENERATING DEVICE COMPRISING THE SAME

(71) Applicant: KT&G CORPORATION, Daejeon (KR)

(72) Inventors: Jang Won Seo, Daejeon (KR); Jin Chul Jung, Daejeon (KR); Chul Ho Jang, Gyeonggi-do (KR); Gyoung Min Go, Daejeon (KR); Hyung Jin Bae, Daejeon (KR); Jong Seong Jeong, Sejong (KR)

(73) Assignee: KT&G Corporation, Daejeon (KR)

( * ) Notice: Subject to any disclaimer, the term of this patent is extended or adjusted under 35 U.S.C. 154(b) by 376 days.

(21) Appl. No.: 18/267,569

(22) PCT Filed: Oct. 26, 2022

(86) PCT No.: PCT/KR2022/016446
§ 371 (c)(1),
(2) Date: Jun. 15, 2023

(87) PCT Pub. No.: WO2023/075401
PCT Pub. Date: May 4, 2023

(65) Prior Publication Data

US 2024/0057672 A1 Feb. 22, 2024

(30) Foreign Application Priority Data

Oct. 26, 2021 (KR) ..... 10-2021-0143730

(51) Int. Cl.
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
None
See application file for complete search history.

(56) References Cited

U.S. PATENT DOCUMENTS

2017/0027233 A1 2/2017 Mironov
2017/0360102 A1 12/2017 Li et al.
(Continued)

FOREIGN PATENT DOCUMENTS

CN 207236078 U 4/2018
CN 112739225 A 4/2021
(Continued)

OTHER PUBLICATIONS

International Search Report for PCT/KR2022/016446 dated Feb. 1, 2023 (PCT/ISA/210).
(Continued)

*Primary Examiner* — Linda L Gray
(74) *Attorney, Agent, or Firm* — Foley & Lardner LLP

(57) ABSTRACT

Provided is an aerosol-generating device including a heating assembly including an accommodation space into which at least a portion of the aerosol-generating article is accommodated, and at least one spiral coil arranged outside of the accommodation space and configured to generate an induced magnetic field. The spiral coil has a plate shape curved along a circumference direction of the accommodation space and a center around which the spiral coil is wound is at an external surface of the accommodation space.

12 Claims, 12 Drawing Sheets

(56) References Cited

U.S. PATENT DOCUMENTS

| | | | | |
|---|---|---|---|---|
| 2018/0070639 | A1 | 3/2018 | Chen et al. | |
| 2018/0125119 | A1 | 5/2018 | Cadieux et al. | |
| 2020/0029616 | A1 | 1/2020 | Uthurry | |
| 2020/0054069 | A1 | 2/2020 | Blandino et al. | |
| 2020/0397035 | A1 | 12/2020 | Lee et al. | |
| 2021/0137167 | A1 | 5/2021 | Aoun et al. | |
| 2021/0244101 | A1 | 8/2021 | Fraser et al. | |
| 2021/0307379 | A1 | 10/2021 | Kim et al. | |
| 2022/0015413 | A1 | 1/2022 | Black et al. | |
| 2022/0132931 | A1* | 5/2022 | Oh | H05B 6/105 131/329 |
| 2023/0148663 | A1 | 5/2023 | Lim | |

FOREIGN PATENT DOCUMENTS

| | | | |
|---|---|---|---|
| CN | 113163873 | A | 7/2021 |
| CN | 113453571 | A | 9/2021 |
| EP | 1 628 110 | A1 | 2/2006 |
| JP | 2013-204658 | A | 10/2013 |
| JP | 2015-003427 | A | 1/2015 |
| JP | 2019-212538 | A | 12/2019 |
| KR | 10-2017-0007270 | A | 1/2017 |
| KR | 10-2018-0111460 | A | 10/2018 |
| KR | 10-2019-0124748 | A | 11/2019 |
| KR | 10-2020-0009016 | A | 1/2020 |
| KR | 10-2020-0068449 | A | 6/2020 |
| KR | 10-2020-0099481 | A | 8/2020 |
| RU | 2712463 | C1 | 1/2020 |
| WO | 2019/030166 | A1 | 2/2019 |
| WO | WO-2020/166888 | A1 | 8/2020 |
| WO | WO-2020/182760 | | 9/2020 |
| WO | WO-2020/249648 | A1 | 12/2020 |

OTHER PUBLICATIONS

Written Opinion for PCT/KR2022/016446 dated Feb. 1, 2023 (PCT/ISA/237).

Korean Office Action dated Dec. 6, 2023 in Korean Application No. 10-2021-0143730.

Notice of Reasons for Refusal Office Action on Japanese Application No. 2023-547298 dated Jul. 22, 2024 (5 pages).

Office Action dated Oct. 23, 2024, received in Russian Patent Application No. 2023116853.

Extended European Search Report dated Apr. 16, 2024 in Application No. 22887597.7.

Chinese Office Action on CN Patent Application No. 202280008690.8 dated Jan. 15, 2026.

Chinese Office Action on CN Patent Application No. 202280008690.8 dated May 23, 2026.

* cited by examiner

【Figure 1】
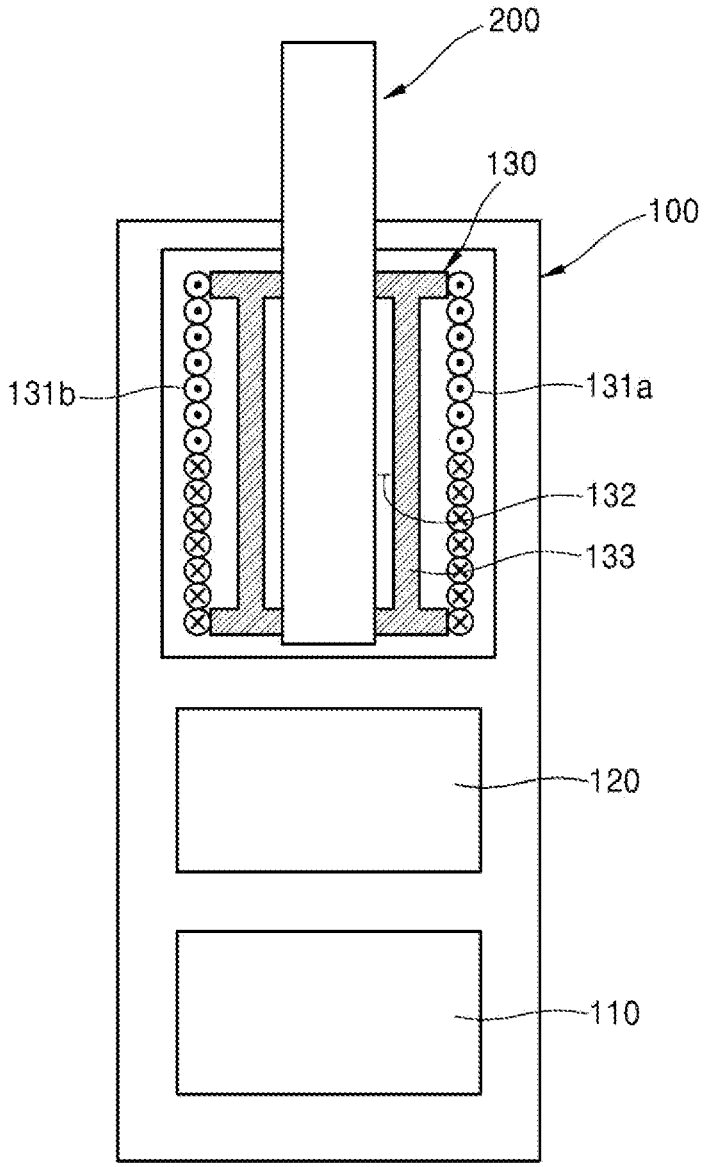

【Figure 2】
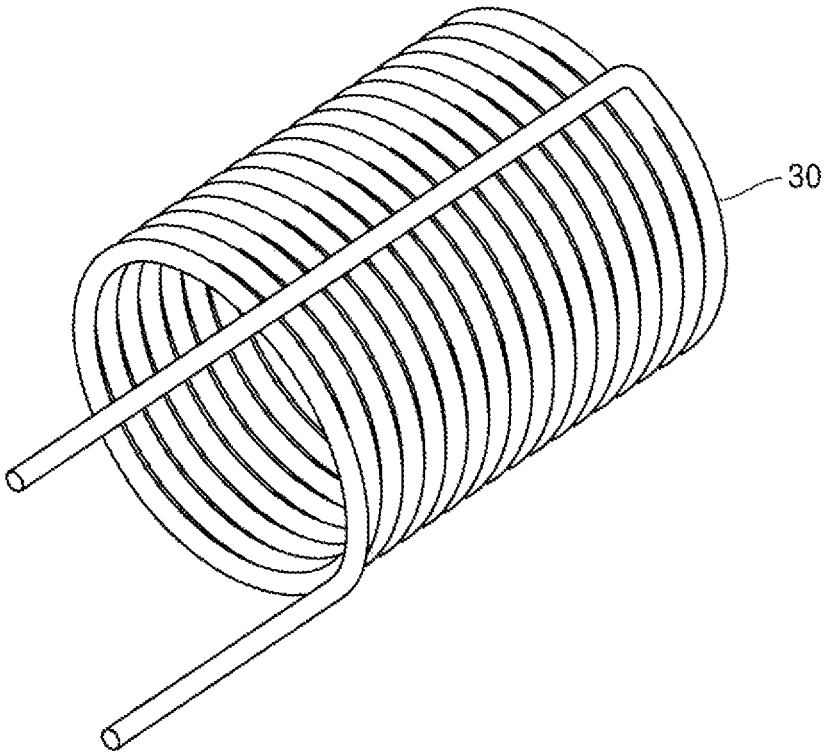

【Figure 3】
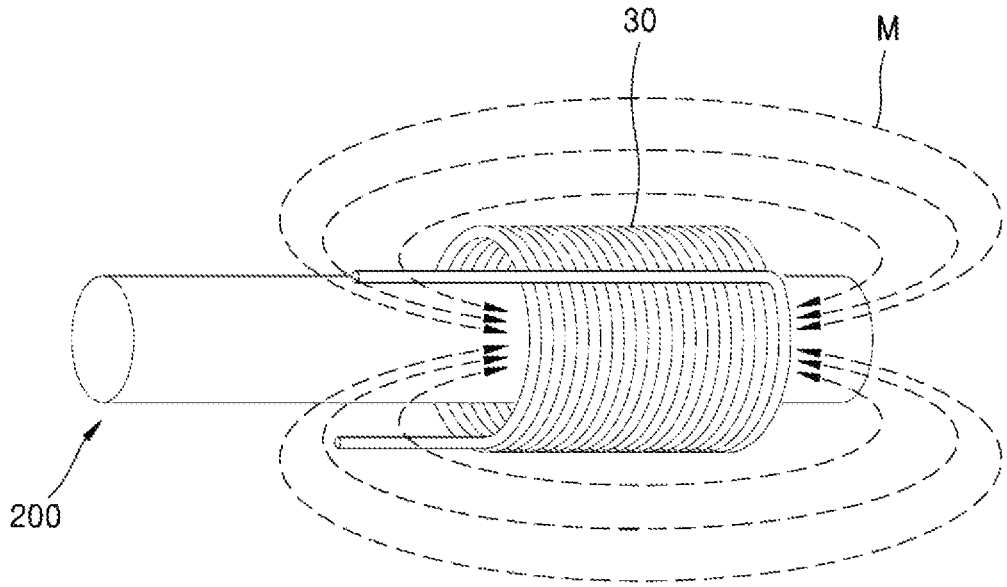

【Figure 4】
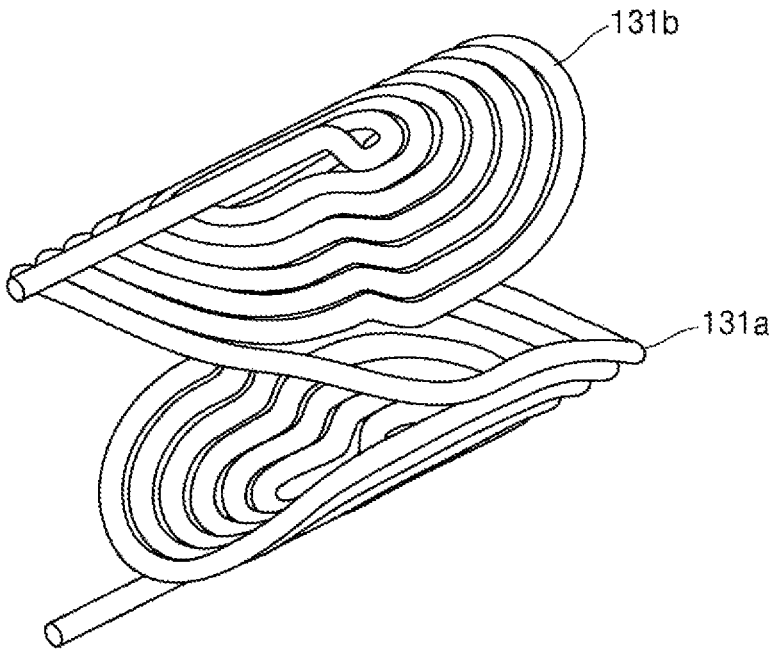

【Figure 5】
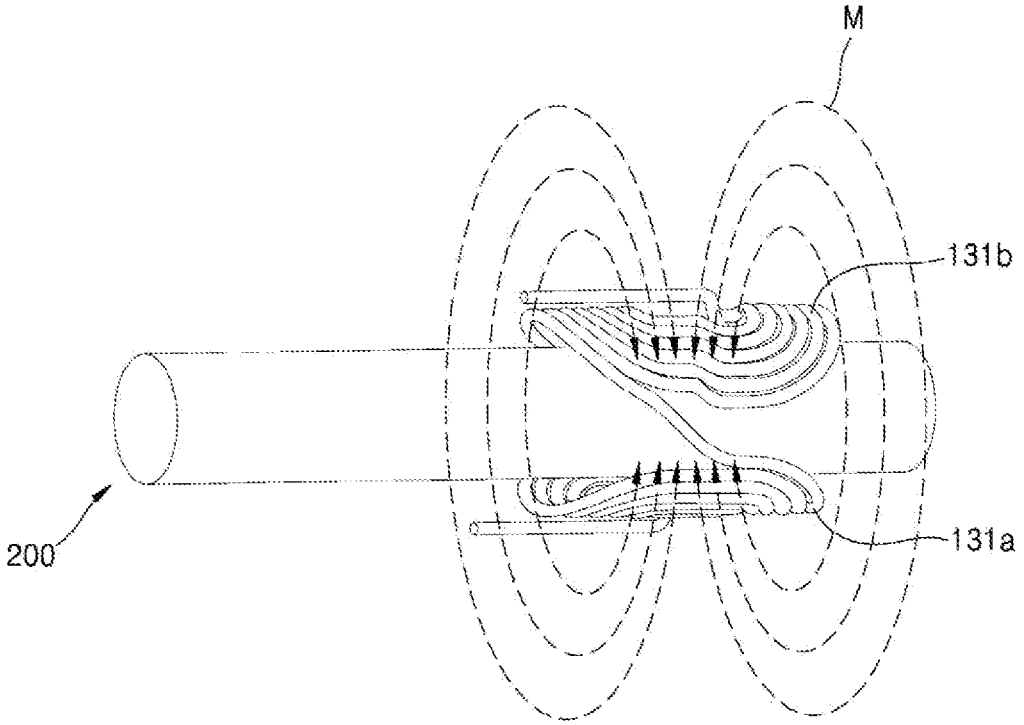

【Figure 6】
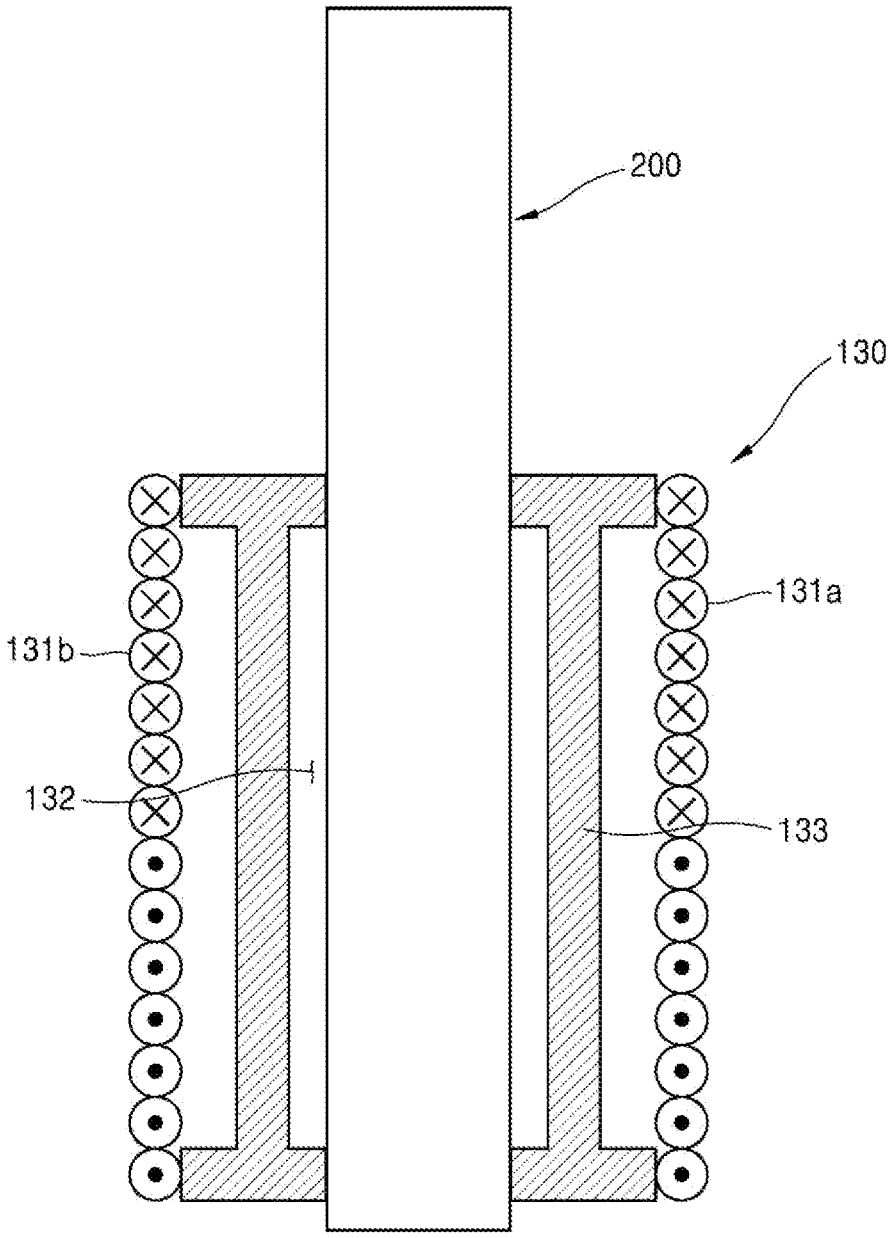

【Figure 7】
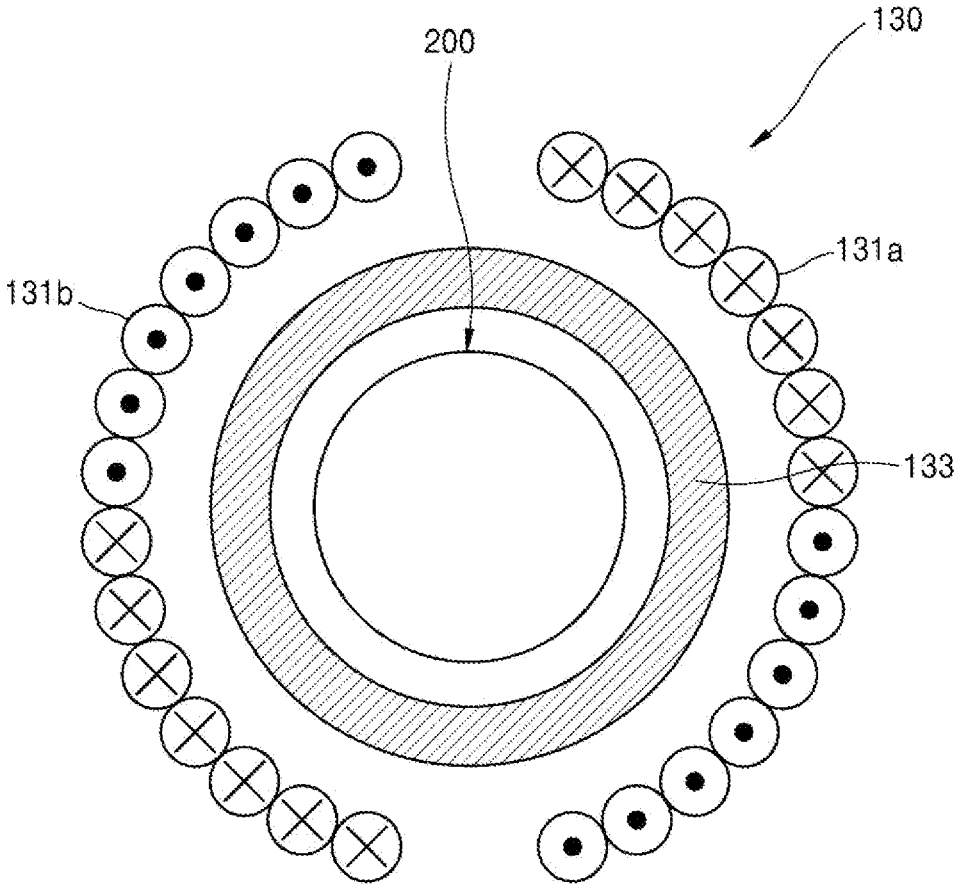

【Figure 8】
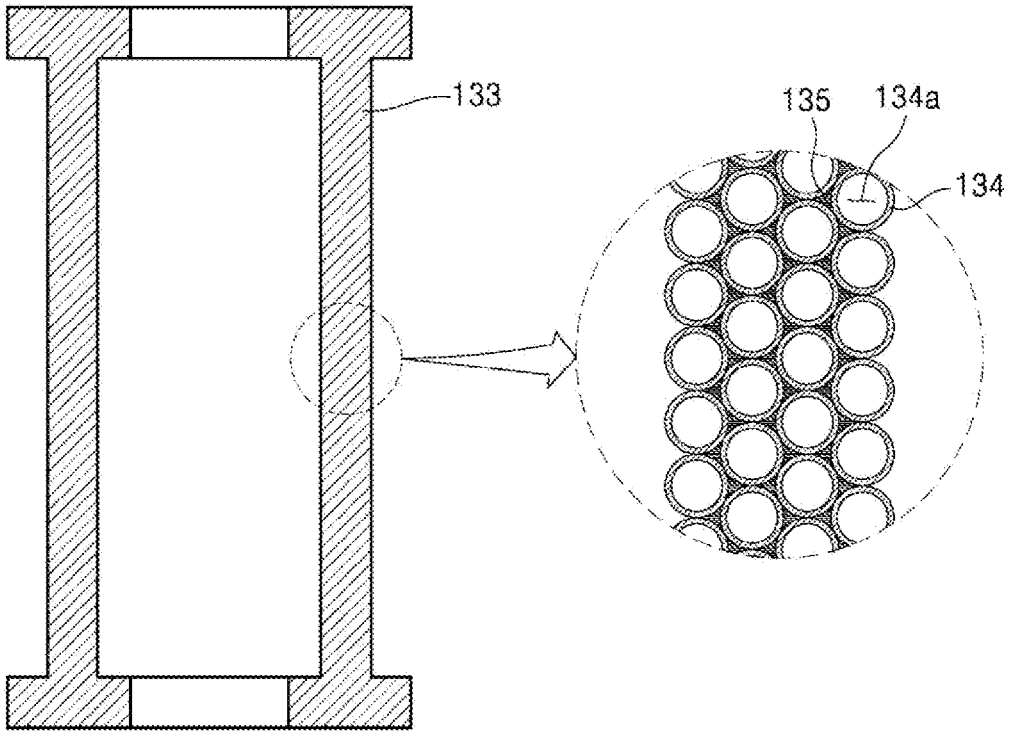

【Figure 9】
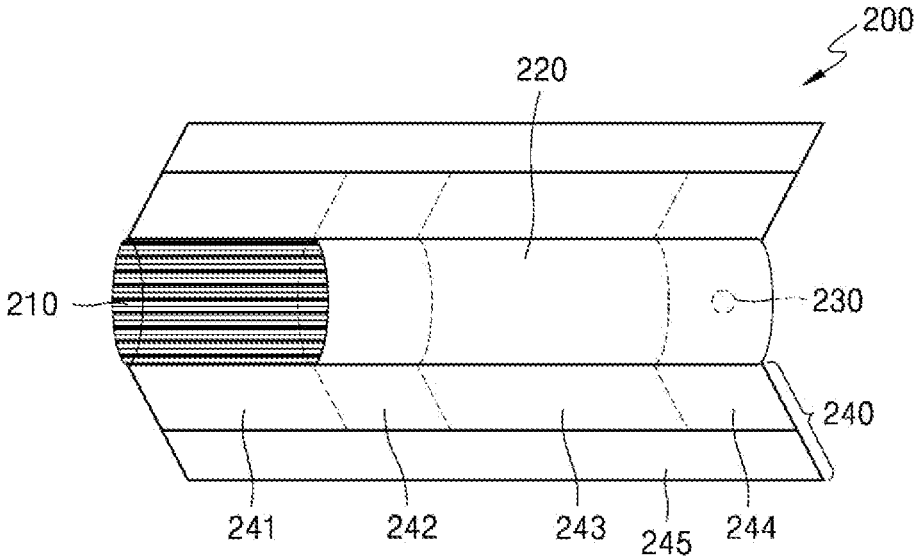

[Figure 10]
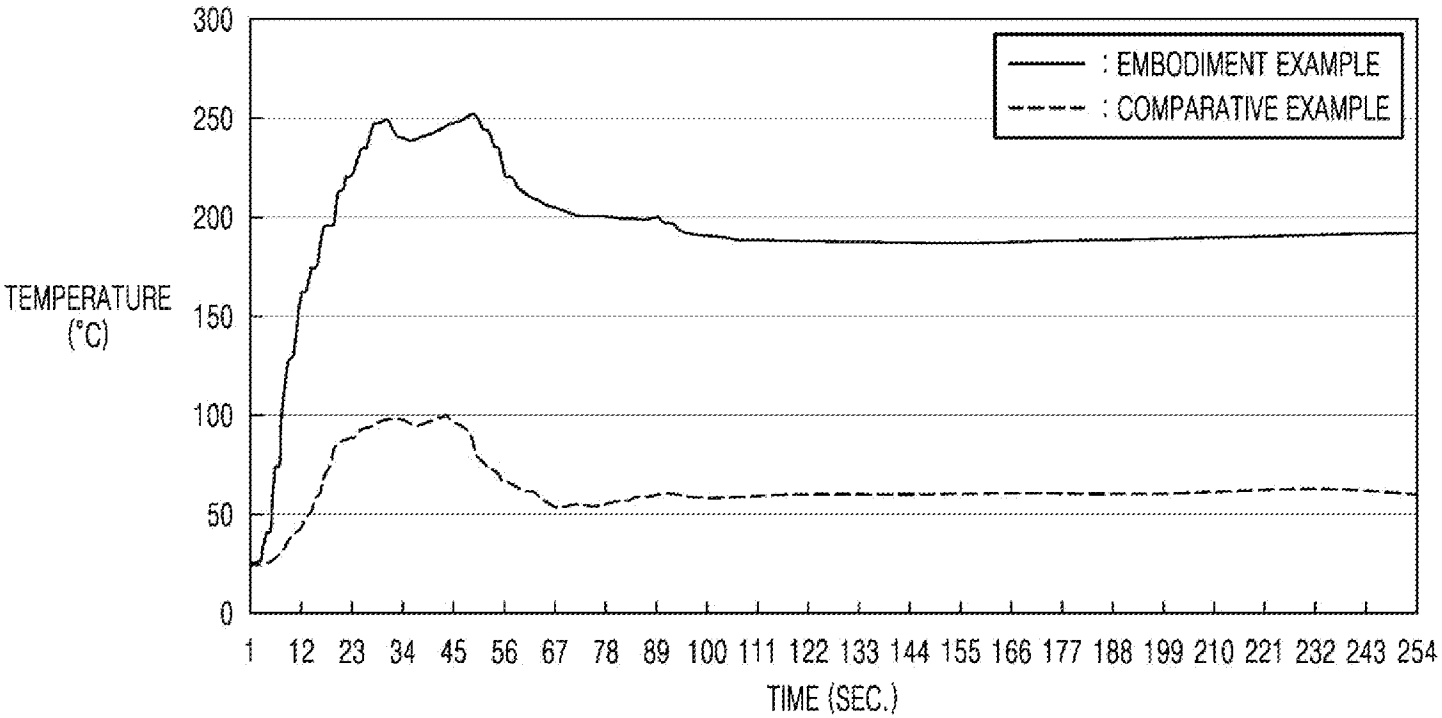

【Figure 11】
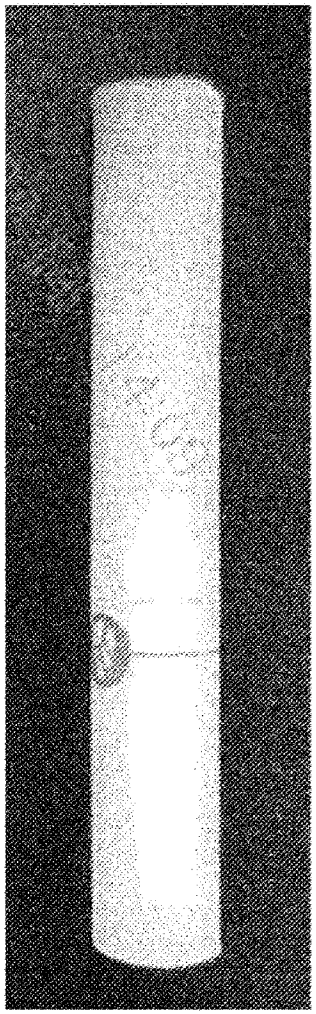

【Figure 12】
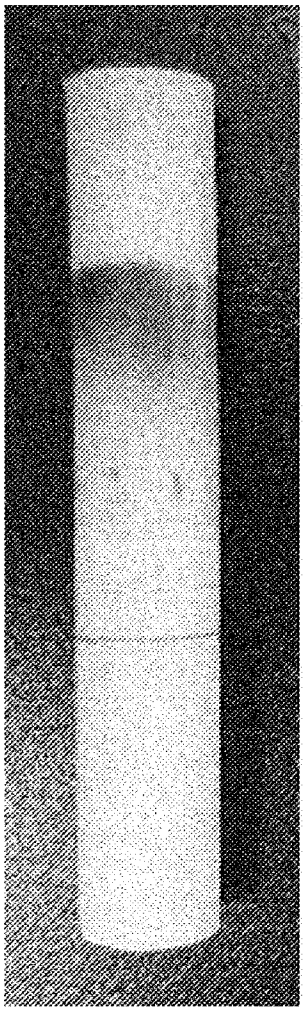

HEATING ASSEMBLY AND AEROSOL GENERATING DEVICE COMPRISING THE SAME

CROSS REFERENCE TO RELATED APPLICATIONS

This application is a National Stage of International Application No. PCT/KR2022/016446 filed Oct. 26, 2022, claiming priority based on Korean Patent Application No. 10-2021-0143730 filed Oct. 26, 2021.

TECHNICAL FIELD

Embodiments relate to a heating assembly and an aerosol-generating device including the same, and more particularly, to a heating assembly capable of efficiently heating a susceptor included in an aerosol-generating article, and an aerosol-generating device including the heating assembly.

BACKGROUND ART

Recently, the demand for alternative methods to overcome the disadvantages of traditional cigarettes has increased. For example, there is growing demand for an aerosol generating device which generates aerosol by heating an aerosol generating material, rather than by combusting cigarettes. Accordingly, researches on a heating-type aerosol generating device has been actively conducted.

Methods of heating an aerosol-generating article by an aerosol-generating device may be classified into an electrical resistance heating method and an induction heating method. In the case of an induction heating type aerosol-generating device, a susceptor, which is heated by an external magnetic field, is arranged around or inside an aerosol-generating article, and a magnetic field is induced by a coil so that the susceptor generates heat.

DISCLOSURE OF INVENTION

Technical Problem

A conventional induction heating type aerosol-generating device includes a susceptor and a coil, and as the susceptor is heated by the magnetic field generated by the coil, heat energy is delivered to an aerosol-generating article.

Recently, a method of heating a susceptor included in an aerosol-generating article without arranging a separate susceptor in an aerosol-generating device has been actively studied. However, the shape of the coil used in the conventional induction heating type aerosol-generating device is not appropriate for heating a susceptor included in the aerosol-generating article, and the aerosol-generating article is not efficiently heated.

As such, an object of the present disclosure is to provide a heating assembly capable of efficiently heating a susceptor included in an aerosol-generating article, and an aerosol-generating device including the same.

The technical problems to be solved through the embodiments are not limited to the aforementioned technical problem, and technical problems that are not mentioned may be clearly understood by one of ordinary skill in the art to which the embodiments belong from the present specification and the accompanying drawings.

Solution to Problem

An aerosol-generating device for heating an aerosol-generating article including a susceptor, according to an embodiment, includes a heating assembly including an accommodation space into which at least a portion of the aerosol-generating article is accommodated; and at least one spiral coil arranged outside of the accommodation space and configured to generate an induced magnetic field, wherein the spiral coil has a plate shape curved along a circumference direction of the accommodation space, and a center around which the spiral coil is wound is at an external surface of the accommodation space.

A heating assembly for heating an aerosol-generating article including a susceptor, according to another embodiment, includes an accommodation space which accommodates at least a portion of the aerosol-generating article, and at least one spiral coil arranged outside of the accommodation space and configured to generate an induced magnetic field, wherein the spiral coil has a plate shape curved along a circumference direction of the accommodation space, and a center around which the spiral coil is wound is at an external surface of the accommodation space.

The technical solution is not limited to the above description, and may include all the matters that may be inferred by one of ordinary skill in the art throughout the specification.

Advantageous Effects of Invention

According to a heating assembly and an aerosol-generating device including the same according to embodiments, a susceptor included in an aerosol-generating article may be efficiently heated by an alternating magnetic field induced by a spiral coil.

The effects of the embodiments are not limited to the above description, and may include all the effects that may be inferred from the configuration described later.

BRIEF DESCRIPTION OF DRAWINGS

FIG. 1 is a cross-sectional view schematically illustrating an example in which an aerosol-generating article is inserted into an aerosol-generating device, according to an embodiment.

FIG. 2 is a diagram schematically illustrating a coil of a conventional aerosol-generating device.

FIG. 3 is a view illustrating the direction of the magnetic force line generated by the coil of the conventional aerosol-generating device.

FIG. 4 is a view schematically illustrating a spiral coil of an aerosol-generating device, according to an embodiment.

FIG. 5 is a view illustrating the direction of the magnetic force line generated by the spiral coil of an aerosol-generating device, according to an embodiment.

FIG. 6 is a view schematically illustrating a cross-section in a longitudinal direction of a heating assembly, according to an embodiment.

FIG. 7 is a view schematically illustrating a cross-section in a direction intersecting the longitudinal direction of a heating assembly, according to an embodiment.

FIG. 8 is a cross-sectional view schematically illustrating an insulation portion of a heating assembly, according to an embodiment.

FIG. 9 is a view illustrating an example of an aerosol-generating article.

FIGS. 10 to 12 are diagrams showing the results of an experiment for comparing the heating performance of an aerosol-generating device according to an embodiment with the heating performance of a conventional aerosol-generating device.

BEST MODE FOR CARRYING OUT THE INVENTION

An aerosol-generating device for heating an aerosol-generating article including a susceptor, according to an embodiment, includes a heating assembly including an accommodation space into which at least a portion of the aerosol-generating article is accommodated; and at least one spiral coil arranged outside of the accommodation space and configured to generate an induced magnetic field, wherein the spiral coil has a plate shape curved along a circumference direction of the accommodation space, and a center around which the spiral coil is wound is at an external surface of the accommodation space.

The at least one spiral coil may include a plurality of spiral coils which are electrically connected to each other.

The aerosol-generating device may further include an insulation portion which is arranged between the aerosol-generating article, which is inserted into the accommodation space, and the spiral coil.

The aerosol-generating article inserted into the accommodation space may be spaced apart from the insulation portion.

The spiral coil and the insulation portion may be spaced apart from each other.

The insulation portion may include a plurality of hollow beads.

The hollow beads may include one or more kinds of ceramics selected from the group consisting of silica, alumina, glass bubble, and perlite.

A heating assembly for heating an aerosol-generating article including a susceptor, according to another embodiment, includes an accommodation space which accommodates at least a portion of the aerosol-generating article, and at least one spiral coil arranged outside of the accommodation space and configured to generate an induced magnetic field, wherein the spiral coil has a plate shape curved along a circumference direction of the accommodation space, and a center around which the spiral coil is wound is at an external surface of the accommodation space.

The at least one spiral coil may include a plurality of spiral coils which are electrically connected to each other.

The heating assembly may further include an insulation portion which is arranged between the aerosol-generating article, which is inserted into the accommodation space, and the spiral coil.

The aerosol-generating article inserted into the accommodation space may be spaced apart from the insulation portion.

The spiral coil and the insulation portion may be spaced apart from each other.

The insulation portion may include a plurality of hollow beads.

The hollow beads may include one or more kinds of ceramics selected from the group consisting of silica, alumina, glass bubble, and perlite.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

In addition, while such terms as "first," "second," etc., may be used to describe various components, such components must not be limited to the above terms. The above terms are used only to distinguish one component from another.

Throughout the specification, "aerosol-generating device" may be a device which generates an aerosol from aerosol-generating materials so that the aerosol may be inhaled directly into the user's lungs through the user's mouth.

Throughout the specification, "aerosol-generating article" means an article used for smoking. For example, the aerosol-generating article may be a general combustive cigarette or a heating-type cigarette which is heated by an aerosol-generating device. As another example, the aerosol-generating article may be an article which is used in a manner in which liquid contained in a cartridge is heated.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a cross-sectional view schematically illustrating an example in which an aerosol-generating article 200 is inserted into an aerosol-generating device 100, according to an embodiment.

Referring to FIG. 1, the aerosol-generating device 100 includes a battery 110, a controller 120, and a heating assembly 130. However, embodiments are not limited thereto, other elements may also be included in the aerosol-generating device 100. The arrangement of the battery 110, the controller 120, and the heating assembly 130 may be changed depending on the design of the aerosol-generating device 100.

The battery 110 may supply power for operating the aerosol generating device 100. For example, the battery 110 may supply power to allow an alternating current to be applied to a heating assembly 130, and may supply power for operating the controller 120. Also, the battery 110 may supply power for operations of a display, a sensor, a motor, etc. mounted in the aerosol generating device 100.

The controller 120 may generally control operations of the aerosol generating device 100. In detail, the controller 120 may control not only operations of the battery 110, and the heating assembly 130, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The aerosol generating device 100 may generate aerosol by heating an aerosol generating article 200 by using an induction heating method. The induction heating method may include a method of generating heat from a magnetic substance by applying an alternating magnetic field.

When an alternating magnetic field is applied to a magnetic substance, energy loss may occur in the magnetic substance due to eddy current loss and hysteresis loss. The lost energy may be released from the magnetic substance as thermal energy. As the amplitude or frequency of the alternating magnetic field applied to the magnetic substance increases, the heat energy released from the magnetic substance also increases.

The heating assembly 130 may include spiral coils 131*a* and 131*b*, an accommodation space 132, and an insulation portion 133. The accommodation space 132 may accommodate at least a portion of the aerosol-generating article 200. The accommodation space 132 may include an opening for receiving the aerosol-generating article 200 into the aerosol-generating device 100. The aerosol-generating article 200 may be inserted into the heating assembly 130 through the opening of the accommodation space 132.

The heating assembly 130 may heat the aerosol-generating article which has been inserted into the accommodation space 132. Specifically, when spiral coils 131*a* and 131*b* of the heating assembly 130 generate a magnetic field, the aerosol-generating article 200 may be heated as a susceptor included in the aerosol-generating article 200 generates heat. A detailed description about the aerosol-generating article 200 is given with reference to FIG. 9.

The insulation portion 133 is arranged between the aerosol-generating article 200, which is inserted into the accommodation space 132, and the spiral coils 131*a* and 131*b*, to thereby prevent heat generated in the aerosol-generating article 200 from being transferred to the outside. The insulation portion 133 may have a cylindrical shape which surrounds at least a portion of the accommodation space 132. For example, the insulation portion 133 may have a cylindrical shape that corresponds to the shape of the aerosol-generating article 200.

The insulation portion 133 may improve the heating efficiency of the insulation portion 130 by allowing heat generated in the susceptor of the aerosol-generating article to be concentrated on the aerosol-generating article 200. Furthermore, the insulation portion 133 may shorten the preheating time of the aerosol-generating device 100 and reduce power consumption.

The spiral coils 131*a* and 131*b* may be disposed around the accommodation space 132 and generate an induced magnetic field. The spiral coils 131*a* and 131*b* may receive power from the battery 110. As power is supplied to the spiral coils 131*a* and 131*b*, a magnetic field may be formed in the accommodation space 132. If an alternating current is applied to spiral coils 131*a* and 131*b*, the direction of the magnetic field formed in the accommodation space 132 may change periodically. If the susceptor is exposed to the magnetic field formed by the coil, the susceptor may generate heat.

As the amplitude or frequency of the magnetic field formed by the spiral coils 131*a* and 131*b* changes, the temperature of the susceptor heated may change. The controller 120 may adjust the amplitude or frequency of the alternating magnetic field formed by the spiral coils 131*a* and 131*b* by controlling the power supplied to the spiral coils 131*a* and 131*b*, thereby controlling the temperature of the susceptor.

As an example, the spiral coils 131*a* and 131*b* may include copper, but are not limited thereto. The spiral coils 131*a* and 131*b* may include any one of silver (Ag), gold (Au), aluminum (Al), tungsten (W), zinc (Zn), and nickel (Ni), or an alloy including at least one thereof so that a high current may flow due to a low specific resistance. Details about the spiral coils 131*a* and 131*b* will be described later with reference to FIGS. 4 and 5.

FIGS. 2 and 3 are diagrams illustrating the coil 30 of the conventional induction heating type aerosol-generating device. FIG. 2 is a diagram schematically illustrating a coil 30 of a conventional aerosol-generating device, and FIG. 3 is a view illustrating the direction of the magnetic force line M generated by the coil 30 of the conventional aerosol-generating device.

Referring to FIGS. 2 and 3, the coil 30, which is included in the conventional induction heating type aerosol-generating device, is generally implemented as a solenoid which is made by tightly and uniformly winding the conducting wire in a cylindrical shape. An accommodation space, into which an aerosol-generating article 200 is inserted, may be formed in the inner space of the solenoid.

The coil 30, which is included in the conventional induction heating type aerosol-generating device, may form a magnetic field in which a magnetic force line M enters and exits the solenoid according to the direction of the electric current. That is, the magnetic force line M may enter and exit the accommodation space in the longitudinal direction of the accommodation space, and the magnetic force line M may pass through the inside of the accommodated aerosol-generating article 200 in the longitudinal direction of the aerosol-generating article 200. Here, the longitudinal direction of the accommodation space means the direction in which the length of the accommodation space is extended or the direction in which the aerosol-generating article 200 is inserted into the accommodation space. Likewise, the longitudinal direction of the aerosol-generating article 200 means the direction in which the length of the aerosol-generating article 200 is extended or the direction in which the aerosol-generating article 200 is inserted into the aerosol-generating device.

Since the magnetic force line M passes through the aerosol-generating article 200 in the longitudinal direction of the aerosol-generating article 200, the density of the magnetic force line M in the aerosol-generating article 200 may be low, and accordingly the susceptor may not be able to generate sufficient heat. Particularly, when the susceptor included in the aerosol-generating article 200 has a shape of a sheet surrounding the aerosol-generating article 200, the magnetic force line M rarely passes through a wide area of the sheet. As such, the susceptor may not be sufficiently heated, and thus the aerosol-generating article 200 may not be efficiently heated.

FIGS. 4 and 5 are views illustrating spiral coils 131*a* and 131*b* of an aerosol-generating device, according to an embodiment. FIG. 4 is a view schematically illustrating spiral coils 131*a* and 131*b* of an aerosol-generating device 100, according to an embodiment. FIG. 5 is a view illustrating the direction of the magnetic force line generated by spiral coils 131*a* and 131*b* of an aerosol-generating device 100, according to an embodiment.

Referring to FIGS. 4 and 5, the spiral coils 131*a* and 131*b* may have a plate shape that is curved along the circumference direction of the accommodation space 132. The center of the spiral coils 131*a* and 131*b* (i.e., a center around which the spiral coils 131*a* and 131*b* are wound) may be arranged at (or above) the external surface of the accommodation space 132 (i.e., a side surface of a cylindrical shape defining the accommodation space 132). That is, the cross-section of the spiral coils 131*a* and 131*b* when cut perpendicular to the longitudinal direction of the accommodation space 132 of the spiral coils 131*a* and 131*b* may have a curved shape (i.e., arc shape). The central axis, around which the spiral coils 131*a* and 131*b* are wound, may intersect the longitudinal direction of the accommodation space 132.

According to the direction of the electric current, the spiral coils 131*a* and 131*b* may form a magnetic field in which the magnetic force line M may enter and exit the accommodation space 132 through an area near the center around which the spiral coils 131*a* and 131*b* are wound. That is, the magnetic force line M may enter and exit the accommodation space 132 in a direction intersecting the longitudinal direction of the accommodation space 132, and the magnetic force line M may pass through the inside of the aerosol-generating article 200 in a direction intersecting the longitudinal direction of the aerosol-generating article 200.

Unlike the coil included in the conventional induction heating type aerosol-generating device, the direction of the magnetic force line M intersects the longitudinal direction of the aerosol-generating article 200. As such, the density of the magnetic force line M, which passes through the susceptor included in the aerosol-generating article 200, may increase, and thus the heating efficiency of the susceptor may be improved. Particularly, when the susceptor included in the aerosol-generating article 200 has a shape of a sheet surrounding the aerosol-generating article 200, the magnetic force line M passes through a wide area of the sheet, and thus the susceptor may be heated to a sufficiently high temperature.

A plurality of spiral coils 131*a* and 131*b* may be arranged. As illustrated in FIGS. 4 and 5, two spiral coils 131*a* and 131*b* including a first spiral coil 131*a* and a second spiral coil 131*b* may be arranged. The first spiral coil 131*a* and the second spiral coil 131*b* may have the same size and shape and may be arranged symmetrically about the central axis of the accommodation space 132.

The first spiral coil 131*a* and the second spiral coil 131*b* may have a circular shape when observed in the direction of the central axis of the spiral coils 131*a* and 131*b*. However, the present disclosure is not limited thereto, and the number, size and shape of the spiral coils 131*a* and 131*b* may be modified as needed. For example, the spiral coils may have a rectangular shape when observed in the direction of the central axis of the spiral coils, and four spiral coils may be spaced apart from each other at regular intervals.

As described above, the magnetic force line M may enter and exit the accommodation space 132 in a direction intersecting the longitudinal direction of the accommodation space 132 through an area near the center of the spiral coils 131*a* and 131*b*. Since the magnetic flux density is high in the center of the spiral coils 131*a* and 131*b*, the portion of the aerosol-generating article 200 which is adjacent to the center of the spiral coils 131*a* and 131*b* may be heated to a relatively high temperature, compared to other portions. As such, if a plurality of spiral coils 131*a* and 131*b* are arranged, the center of the spiral coils 131*a* and 131*b* are arranged at a plurality of points on the external surface of the accommodation space 132, and thus the aerosol-generating article 200, which is accommodated in the accommodation space 132, may be evenly heated.

A plurality of spiral coils 131*a* and 131*b* may be arranged to be electrically connected to each other. When a plurality of spiral coils 131*a* and 131*b* are arranged, it may be required to elaboratively control the direction of the alternating current applied to each of the spiral coils 131*a* and 131*b* in order to prevent the magnetic field from being offset due to the intersection of directions of the magnetic fields respectively generated by the spiral coils 131*a* and 131*b*. However, when a plurality of spiral coils 131*a* and 131*b* are electrically connected to each other, separate control is not required because alternating current flows in the plurality of spiral coils 131*a* and 131*b*. Hereinafter, the heating assembly 130 will be described in detail with reference to FIGS. 6 and 7.

FIGS. 6 and 7 are cross-sectional views of a heating assembly 130, according to an embodiment. FIG. 6 is a view schematically illustrating a cross-section of the heating assembly 130 when cut in the longitudinal direction, according to an embodiment.

FIG. 7 is a view schematically illustrating a cross-section of the heating assembly 130 when cut perpendicular to the longitudinal direction, according to an embodiment. Here, the longitudinal direction of the heating assembly 130 may mean a direction in which the length of the heating assembly 130 is extended. In addition, the longitudinal direction may also mean a direction in which the aerosol-generating article 200 is inserted into the accommodation space 132.

Referring to FIGS. 6 and 7, the aerosol-generating article 200, which is inserted into the accommodation space 132, and the insulation portion 133 may be spaced apart from each other. High temperature heat is generated in the susceptor of the aerosol-generating article 200 during the operation of the aerosol-generating device. Here, heat may be unnecessarily delivered to a user, or cause damage to other components of the aerosol-generating device 100. Accordingly, it may be necessary to block the heat generated in the process of using the aerosol-generating device 100.

Since an air layer is formed between the aerosol-generating article 200 and the insulation portion 133, the performance of blocking the movement of the heat generated in the susceptor of the aerosol-generating article 200 may be improved. Particularly, when the susceptor included in the aerosol-generating article 200 has a sheet type which surrounds the aerosol-generating article 200, the susceptor is arranged to closely face a wide area of the insulation portion 133, and thus the insulation portion 133 may be deteriorated by heat generated by the susceptor. As the aerosol-generating article 200 is spaced apart from the insulation portion 133, it may be possible to prevent heat, which is generated in the susceptor of the aerosol-generating article 200, from being directly transferred to the insulation portion 133, thereby preventing the decrease of the insulation performance of the insulation portion 133.

Further, the spiral coils 131*a* and 131*b* may be spaced apart from the insulation portion 133. For example, the spiral coils 131*a* and 131*b* may be spaced apart from the side surface of the insulation portion 133 having a cylindrical shape as a whole. Since an air layer may be formed between the spiral coils 131*a* and 131*b* and the insulation portion 133, the insulation performance may be improved. In addition, as the heat transmitted to the spiral coils 131*a* and 131*b* decreases, the deterioration of the spiral coils 131*a* and 131*b* may also be prevented.

In order to further improve the insulation performance, a vacuum may be created in the space between the aerosol-generating article 200 and the insulation portion 133, and in the space between the spiral coils 131*a* and 131*b* and the insulation portion 133.

The insulation portion 133 may include insulating materials having excellent insulation performance, such as ceramic and glass fibers. However, the present disclosure is not limited thereto, and any insulating material capable of blocking heat generated in the susceptor of the aerosol-generating article 200 may be included in the insulation portion 133 without limitation. Hereinafter, the insulation portion 133 of the heating assembly 130 according to an embodiment will be described in detail with reference to FIG. 8.

FIG. 8 is a cross-sectional view schematically illustrating an insulation portion 133 of a heating assembly 130, according to an embodiment.

Referring to FIG. 8, the insulation portion 133 may include a plurality of hollow beads 134 including hollows 134*a* therein. The insulation effects of the insulation portion 133 including a plurality of hollow beads 134 may be improved by a plurality of hollows 134*a* which exist in the hollow beads 134.

The hollow beads 134 may include one or more ceramics selected from the group consisting of silica, alumina, glass bubble, and perlite, but the present disclosure is not limited thereto, and other materials with a low thermal conductivity may be used.

Specifically, the insulation portion 133 may include a structure formed by packing a plurality of hollow beads 134. For example, as illustrated in FIG. 8, the structure may be formed by sphere-packing a plurality of hollow beads 134. The sphere-packing method may include a method of combining particles to form a structure, such as a body-centered cubic (BCC), a face-centered cubic (FCC), etc., but is not limited thereto.

The structure may be formed by packing and firing a plurality of hollow beads 134. The plurality of packed hollow beads 134 may be fixed by a binder 135. The binder 135 may improve the durability of the structure and improve the insulation performance of the structure by filling a space formed between a plurality of packed hollow beads 134. A polymer with excellent heat resistance may be used as the binder 135. For example, polyimide (PI) may be used, but the present disclosure is not limited thereto.

A structure, which is manufactured by packing a plurality of hollow beads 134, may include a waterproof film formed at the external surface of the structure. The waterproof film may prevent deterioration of the insulation performance of the structure in advance by preventing the aerosol, which is generated in the aerosol-generating article 200 and becomes droplets, from being absorbed in the hollow beads 134. Further, since the waterproof film may block airflow between a plurality of hollow beads 134, the insulation performance may be further improved.

The waterproof film may include, for example, a glass membrane, a polyimide coating film, a water-repellent coating film, or a combination thereof. However, the present disclosure is not limited thereto, and other types of waterproof films having a waterproof (or moisture proof) function may also be used.

For example, the waterproof film may be a glass membrane. The structure may be manufactured through a first firing process of packing and firing a plurality of hollow beads and a second firing process of applying glass frit on the external surface and firing the glass frit. If the melting point of the glass frit is higher than the firing temperature of the porous structure, the external surface of the porous structure may be melted in the second firing process. Hence, a glass frit having a melting point lower than the firing temperature of the first firing process may be used. For example, the firing temperature of the first firing process is equal to or greater than 800° C. and the melting point of the glass frit may be between about 600° C. and about 800° C.

In order to ensure the excellent insulation performance of the structure and the ease of manufacturing, the diameter of the hollow bead 134 may be 75 μm to 500 μm. Preferably, the diameter of the hollow bead 134 may be 100 μm to 450 μm, 150 μm to 450 μm, or 150 μm to 400 μm. For example, the diameter of the hollow beads 134 may preferably be equal to or greater than 75 μm. This is because, as the diameter of the hollow beads 134 increases, the diameter of hollows 134 therein increases, and thus the insulation performance of the structure is improved. In addition, the diameter of the hollow beads 134 may preferably be equal to or less than 500 μm. This is because, as the size of the hollow beads 134 increases, the curvature of the surface increases, and thus it may be difficult to form a waterproof film having a uniform thickness, and the durability of the waterproof film may be reduced.

In order for a structure including a plurality of hollow beads 134 to have a uniform insulation performance over the entire area, the diameter distribution of the plurality of hollow beads 134 may have an error range of less than 30% of the average diameter. Preferably, the diameter distribution of the plurality of hollow beads 134 may have an error range of less than 25%, 23% or 21%. More preferably, the diameter distribution of the plurality of hollow beads 134 may have an error range of less than 20%, 18%, 16%, 14%, 12%, or 10%. More preferably, the diameter distribution of the plurality of hollow beads 134 may have an error range of less than 8%, 6% or 5%.

In an embodiment, an initial structure may be formed by packing hollow beads 134 having a first size, and then a final structure may be formed by packing hollow beads 134 having a second size, onto the external surface of the initial structure. Here, the second size may be smaller than the first size. In this case, since the pore size of the external surface of the structure becomes smaller, external air flow can be effectively blocked. In addition, since the structure also includes hollow beads 134 having large-sized hollows 134*a*, the insulation performance of the structure may be improved.

FIG. 9 is a view illustrating an example of an aerosol-generating article 200.

Referring to FIG. 9, the aerosol generating article 200 includes a tobacco rod 210 and a filter rod 220. FIG. 9 illustrates that the filter rod 220 includes a single segment, but is not limited thereto. In other words, the filter rod 220 may include a plurality of segments.

For example, the filter rod 220 may include a first segment configured to cool an aerosol and a second segment configured to filter a certain component included in the aerosol. Also, as necessary, the filter rod 220 may further include at least one segment configured to perform other functions.

The aerosol generating article 200 may be packaged by at least one wrapper 240. The wrapper 240 may have at least one hole through which external air may be introduced or internal air may be discharged. For example, the aerosol generating article 200 may be packaged by one wrapper 240.

As another example, the aerosol generating article 200 may be doubly packaged by two or more wrappers 240. For example, the tobacco rod 210 may be packaged by a first wrapper 241, and the filter rod 220 may be packaged by wrappers 242, 243, 244. Also, the entire aerosol generating article 200 may be re-packaged by another single wrapper 245. When the filter rod 220 includes a plurality of segments, each segment may be packaged by wrappers 242, 243, 244.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand.

Also, the tobacco rod 210 may be formed as a pipe tobacco, which is formed of tiny bits cut from a tobacco sheet.

The tobacco rod 210 may include a susceptor heated by a magnetic field. The susceptor may contain metal or carbon. The susceptor may include at least one of ferrite, ferromagnetic alloy, stainless steel, and aluminum (AL). In addition, the susceptor may include at least one ceramic material, such as graphite, molybdenum, silicon carbide, niobium, nickel alloy, metal film, or zirconia, transition metal, such as nickel (Ni) or cobalt (Co), and metalloid, such as boron (B) or phosphorus (P).

The susceptor included in the tobacco rod 210 may have various forms. For example, a susceptor may have a sheet form and may surround the outside of the tobacco rod 210. As another example, the susceptor may be provided in the form of strands or particles, which are dispersed and disposed in the tobacco rod 210.

Also, the tobacco rod 210 may be surrounded by a heat conductive material. For example, the heat conductive material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod 210 may be increased and taste of the aerosol may be improved. Also, the heat conductive material surrounding the tobacco rod 210 may function as a susceptor heated by the induction heater.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may generate a flavor or an aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Although it is not shown in the drawings, the aerosol-generating article 200 may further include a front-end plug. The front-end plug may be located on one side of the tobacco rod 210 which is opposite to the filter rod 220. The front-end plug may prevent the tobacco rod 210 from being detached outwards and prevent the liquefied aerosol from flowing from the tobacco rod 210 into the aerosol generating device (100 of FIG. 1).

Experimental Example. Comparison of Heating Performance of Aerosol-Generating Devices An experiment was conducted to compare the heating performance of an aerosol-generating device according to an embodiment with a conventional aerosol-generating device.

An aerosol-generating article including a sheet-type susceptor was used for the experiment, and an aluminum foil was used as the sheet-type susceptor. The aluminum foil was arranged to surround the tobacco rod of the aerosol-generating article.

An aerosol-generating article was heated using an aerosol-generating device including a solenoid as shown in FIG. 2 (hereinafter "comparative example") and an aerosol-generating device including spiral coils 131*a* and 131*b* as shown in FIG. 4 (hereinafter "embodiment example"), and the change in the temperature of the aluminum foil of the aerosol-generating article was measured over time. The alternating current of the same condition was applied to the solenoid of the comparative example and the spiral coils of the embodiment example.

FIGS. 10 to 12 are diagrams showing the result of an experiment for comparing the heating performance between an aerosol-generating device according to an embodiment and a conventional aerosol-generating device. FIG. 10 shows a temperature change graph over time of aluminum foils of aerosol-generating articles according to an embodiment example and a comparative example. FIG. 11 is an image showing the appearance of an aerosol-generating article according to a comparative example after being heated in the experiment, and FIG. 12 is an image showing the appearance of an aerosol-generating article according to an embodiment example after being heated in the experiment.

Referring to FIG. 10, in the case of the embodiment example, the aluminum foil of the aerosol-generating article was heated to a temperature between about 200° C. about 250° C., except for the preheating section. Meanwhile, in the case of the comparative the aluminum foil of the aerosol-generating article was heated to a temperature between about 50° C. to about 100° C. When considering the fact that the aerosol-generating material (glycerin, etc.) included in a general aerosol-generating article has a vaporization temperature of about 140° C. about 250° C., normal aerosol generation may be difficult in the case of the comparative Referring to FIGS. 11 and 12, there was no change in the external appearance of the aerosol-generating article heated according to the comparative example. On the other hand, in the case of the aerosol-generating article heated according to the example, the surface of the wrapper, in which the aluminum foil was located, was carbonized. As such, it may be confirmed that the spiral coils of the embodiment example can more effectively heat the aerosol-generating article than the solenoid of the comparative example.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol-generating device for heating an aerosol-generating article including a susceptor, the aerosol-generating device comprising:

a heating assembly including:

an accommodation space into which at least a portion of the aerosol-generating article is accommodated; and at least one spiral coil arranged outside of the accommodation space and configured to generate an induced magnetic field, wherein the at least one spiral coil has a plate shape curved along a circumference direction of the accommodation space, and a center around which the at least one spiral coil is wound is at an external surface of the accommodation space, wherein the at least one spiral coil includes a plurality of spiral coils which are electrically connected to each other.

2. The aerosol-generating device of claim 1, further comprising an insulation portion which is arranged between the aerosol-generating article and the at least one spiral coil when the aerosol-generating article is inserted into the accommodation space.

3. The aerosol-generating device of claim 2, wherein the aerosol-generating article inserted into the accommodation space is spaced apart from the insulation portion.

4. The aerosol-generating device of claim 2, wherein the at least one spiral coil and the insulation portion are spaced apart from each other.

5. The aerosol-generating device of claim 2, wherein the insulation portion includes a plurality of hollow beads.

6. The aerosol-generating device of claim 5, wherein the hollow beads include at least one ceramic material selected from the group consisting of silica, alumina, glass bubble, and perlite.

7. A heating assembly for heating an aerosol-generating article including a susceptor, the heating assembly comprising:

an accommodation space into which at least a portion of the aerosol-generating article is accommodated; and at least one spiral coil arranged outside of the accommodation space and configured to generate an induced magnetic field, wherein the at least one spiral coil has a plate shape curved along a circumference direction of the accommodation space, and a center around which the at least one spiral coil is wound is at an external surface of the accommodation space, wherein the at least one spiral coil includes a plurality of spiral coils which are electrically connected to each other.

8. The heating assembly of claim 7, further comprising an insulation portion which is arranged between the aerosol-generating article and the at least one spiral coil when the aerosol-generating article is inserted into the accommodation space.

9. The heating assembly of claim 8, wherein the aerosol-generating article inserted into the accommodation space is spaced apart from the insulation portion.

10. The heating assembly of claim 8, wherein the at least one spiral coil and the insulation portion are spaced apart from each other.

11. The heating assembly of claim 8, wherein the insulation portion includes a plurality of hollow beads.

12. The heating assembly of claim 11, wherein the hollow beads include at least one ceramic material selected from the group consisting of silica, alumina, glass bubble, and perlite.

* * * * *